US007839364B2

(12) United States Patent
Ahn et al.

(10) Patent No.: US 7,839,364 B2
(45) **Date of Patent: *Nov. 23, 2010**

(54) PIXEL CIRCUIT OF ORGANIC LIGHT EMITTING DISPLAY

(75) Inventors: Tae Joon Ahn, Seoul (KR); Sang Hoon Jung, Seoul (KR)

(73) Assignee: LG Display Co., Ltd., Seoul (KR)

( * ) Notice: Subject to any disclaimer, the term of this patent is extended or adjusted under 35 U.S.C. 154(b) by 792 days.

This patent is subject to a terminal disclaimer.

(21) Appl. No.: 11/638,389

(22) Filed: Dec. 14, 2006

(65) Prior Publication Data

US 2007/0268217 A1 Nov. 22, 2007

(30) Foreign Application Priority Data

May 18, 2006 (KR) ..... 10-2006-0044675

(51) Int. Cl.
*G09G 3/20* (2006.01)

(52) U.S. Cl. ..... 345/76; 345/82; 345/87; 345/92

(58) Field of Classification Search ..... 345/36, 345/39, 42, 44–46, 48, 76–78, 81–84, 87–88, 345/90–92, 95, 204, 214, 690; 315/169.3
See application file for complete search history.

(56) References Cited

U.S. PATENT DOCUMENTS 7,202,606 B2 * 4/2007 Eom et al. ..... 315/169.3
7,259,735 B2 * 8/2007 Kasai ..... 345/77
7,573,441 B2 * 8/2009 Kwon ..... 345/76
7,688,292 B2 * 3/2010 Park et al. ..... 345/82
2004/0196239 A1 10/2004 Kwon
2005/0212446 A1 * 9/2005 Eom ..... 315/169.3
2007/0200793 A1 * 8/2007 Kwon ..... 345/39

FOREIGN PATENT DOCUMENTS

JP 2004-310006 11/2004
JP 2006-039527 2/2006

* cited by examiner

*Primary Examiner*—Quan-Zhen Wang
*Assistant Examiner*—Mansour M Said
(74) *Attorney, Agent, or Firm*—McKenna Long & Aldridge

(57) ABSTRACT

A pixel circuit of an organic light emitting display includes a first transistor that transmits a data signal from a data line in response to a scan signal from a scan line; a first capacitor that stores the data signal received from the first transistor; a second transistor for threshold voltage compensation; a third transistor that transmits the threshold voltage of the second transistor; a fourth transistor that connects the gate and drain of the second transistor in a diode-connected configuration in response to a control signal from a control line; a second capacitor that stores the threshold voltage received through the third transistor; a fifth transistor that generates a driving current corresponding to a combined voltage of the first and the second capacitors due to the turned on third transistor; and an organic light emitting diode that emits light according to the driving current.

19 Claims, 8 Drawing Sheets

PIXEL CIRCUIT OF ORGANIC LIGHT EMITTING DISPLAY

This application claims the benefit of Korea Patent Application No. 10-2006-044675, filed on May 18, 2006, which is incorporated herein by reference for all purposes as if fully set forth herein.

BACKGROUND OF THE INVENTION

1. Field of the Invention

The present invention relates to a pixel circuit of an organic light emitting display.

2. Discussion of the Related Art

Recently, as multimedia applications and their use increase, the more important the flat panel displays (FPD) become. Hence, various flat panel displays such as a liquid crystal display (LCD), a plasma display panel (PDP) or an organic light emitting display are used more and more.

The organic light emitting display has rapid response time, low power consumption, and self-emission structure. Furthermore, the organic light emitting display has a wide viewing angle, so that it can excellently display a moving picture regardless of the size of the screen or the position of a viewer. Because the organic light emitting display may be manufactured in low temperature environment and by using a semiconductor fabrication process, the organic light emitting display has a simple manufacturing process. Hence, the organic light emitting display is attractive as a next generation display.

Generally, the organic light emitting display emits light by electrically exciting an organic compound. To display a predetermined image, the organic light emitting display has N×M organic light emitting diodes arranged in a matrix format and may be voltage driven or current driven. The driving methods of the organic light emitting display include a passive type and an active type using a thin film transistor.

In the passive type, an anode electrode is at right angles to a cathode electrode. The anode electrode is selected by a scan signal and the cathode electrode receives a data signal, so that the OLED emits light according to the data signal applied between the cathode electrode and the anode electrode.

In the active type, the thin film transistor is connected to an ITO (Indium Tin Oxide) electrode and a gate electrode of the thin film transistor is connected to capacitor, so that the OLED emits light according to a voltage stored in the capacitor.

FIG. 1 is block diagram showing a conventional organic light emitting display.

Referring to FIG. 1, the organic light emitting display has a display panel 110, a scan driver 120, a data driver 130, a controller 140 and power supply 150.

The display panel 110 has data lines D1-Dm, scan lines S1-Sn, and pixel circuits P11-Pnm. The data lines D1-Dm are arranged in a first direction and cross the scan lines S1-Sn arranged in second direction. The pixel circuits P11-Pnm are disposed at pixel regions defined by the data lines D1-Dm and the scan lines S1-Sn.

The controller 140 outputs a control signal to the scan driver 120, the data driver and the power supply 150.

The power supply 150 outputs voltages required to the scan driver 120, the data driver and the display panel 110 according to control signals from the controller 140.

The scan driver 120 outputs a scan signal to the scan lines S1-Sn connected to the scan driver 120 according to the control signal of the controller 140. Hence, the pixel circuits P11-Pnm of the display panel 110 are selected by the scan signal.

The data driver 130 is synchronized with the scan signal output from the scan driver 120 according to the controller 140, so that the data driver 130 applies a data signal to the pixel circuit P1-Pnm through the data lines D1-Dm connected to the data driver 130. Hence, the display panel 110 displays predetermined image by light-emitting operation of the pixel circuits P1-Pnm in response to the data signal.

FIG. 2 is circuit diagram showing a pixel circuit of a conventional organic light emitting display.

Referring to FIG. 2, the pixel circuit includes a switching transistor MS, a capacitor Cgs, a driving transistor MD and an OLED(Organic Light Emitting Diode). The switching transistor MS transmits a data signal from a data line Dm in response to a scan signal of a scan line Sn. The data signal through the switching transistor MS is stored in the capacitor Cgs. The data signal stored in the capacitor Cgs is used in generating a driving current for the driving transistor MD. Hence, the OLED performs light-emitting operation according to the driving current.

The driving current $I_{OLED}$ flowing through the OLED is shown by the following equation 1.

$$I_{OLED} = \frac{1}{2}K(Vgs - Vth)^2 \qquad \text{Equation 1}$$

Vgs denotes source-gate voltage of the driving transistor, and Vth denotes threshold voltage of the driving transistor.

The organic light emitting display of the pixel circuit is an active matrix type and may control brightness by the driving current $I_{OLED}$ flowing through the OLED. Hence, uniformity of a thin film transistors, threshold voltages Vth of the thin film transistors and mobility of charge carriers should be achieved in order to have a uniform display.

The thin film transistor used in the organic light emitting display may be formed by using amorphous silicon or low temperature poly-silicon. The poly-silicon has 100 to 200 times larger electron mobility than that of the amorphous silicon, so that the thin film transistor using the poly-silicon is needed to the organic light emitting display in order to have high switching speed.

The poly-silicon may be manufactured by crystallization of the amorphous silicon, using an eximer laser to anneal the amorphous silicon. When the amorphous silicon is crystallized, grain size of the poly-silicon may not be uniform due to non-uniformity of the pulse amplitude produced by the eximer laser. Hence, each thin film transistor has different characteristics, so that each pixel may have a different brightness for the same gray scale.

SUMMARY OF THE INVENTION

Accordingly, the present invention is directed to a pixel circuit of organic light emitting display that substantially obviates one or more of the problems due to limitations and disadvantages of the related art.

An advantage of the present invention to provide a pixel circuit of an organic light emitting display for effectively compensating a threshold voltage and mobility of thin film transistors and allowing a uniform brightness for low gray scale levels to be displayed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a pixel circuit of an organic light emitting display includes a first transistor that transmits a data signal from a data line in response to a scan signal from a scan line; a first capacitor that stores the data signal received from the first transistor; a second transistor for threshold voltage compensation; a third transistor that transmits the threshold voltage of the second transistor; a fourth transistor that connects the gate and drain of the second transistor in a diode-connected configuration in response to a control signal from a control line; a second capacitor that stores the threshold voltage received through the third transistor; a fifth transistor that generates a driving current corresponding to a combined voltage of the first and the second capacitors due to the turned on third transistor; and an organic light emitting diode that emits light according to the driving current.

It is to be understood that both the foregoing general description and the following detailed description are exemplary and explanatory and are intended to provide further explanation of the invention as claimed.

BRIEF DESCRIPTION-OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to an embodiment of the present invention, examples of which is illustrated in the accompanying drawings.

Figure 1:
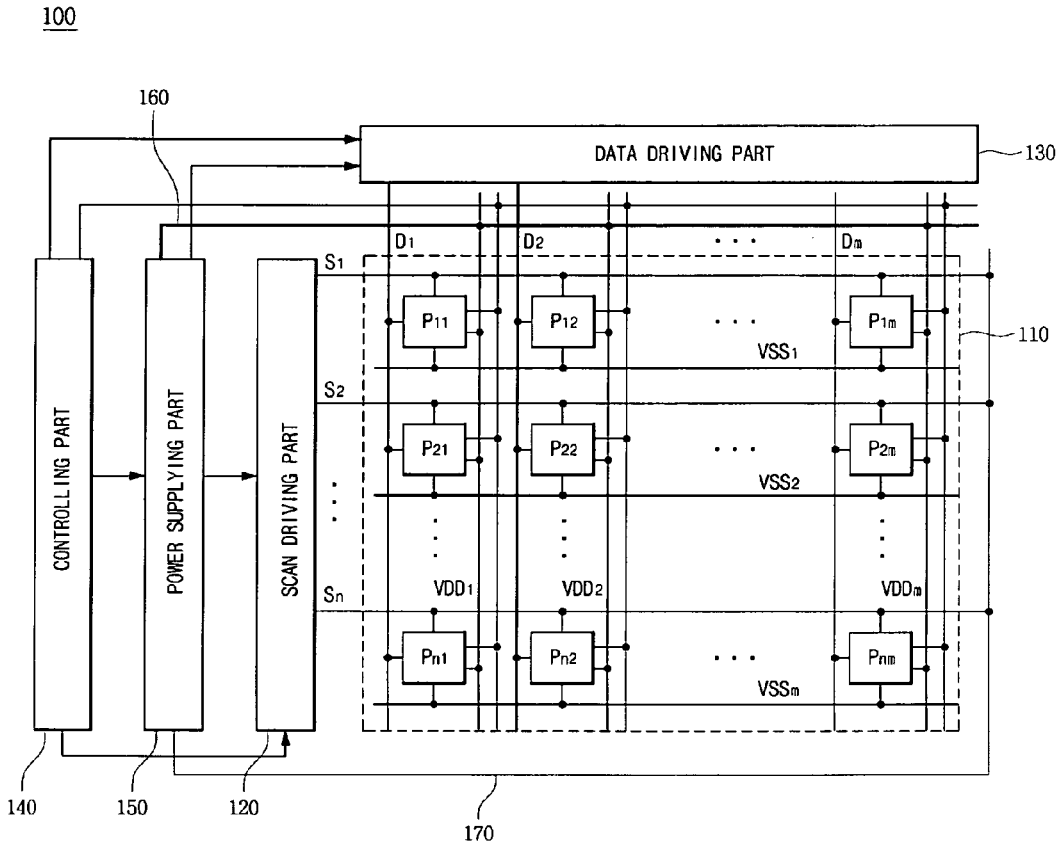
FIG. 1 (Related Art)
FIG. 1 is a block diagram showing a conventional organic light emitting display.
Figure 2:
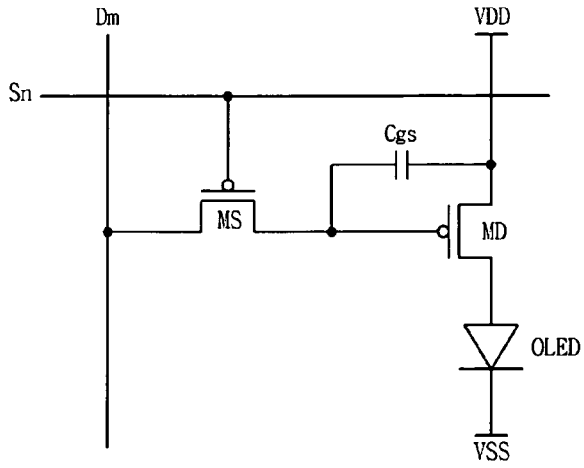
FIG. 2 (Related Art)
FIG. 2 is a circuit diagram showing a pixel circuit of a conventional organic light emitting display.
Figure 3A:
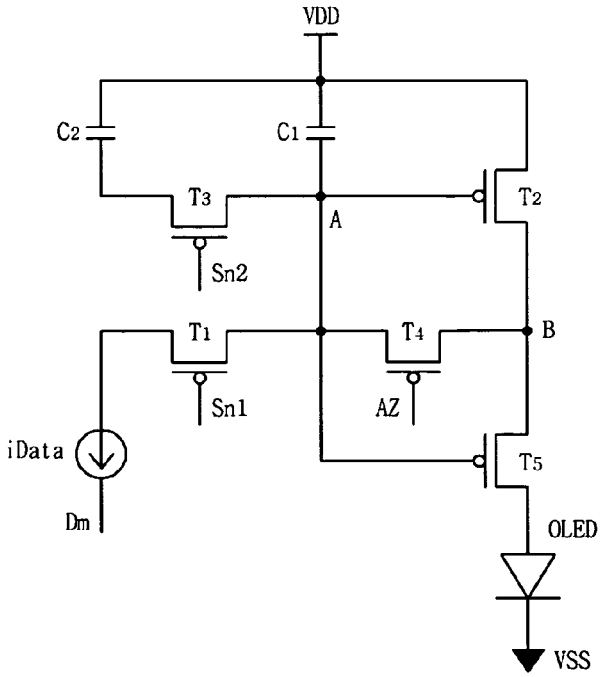
FIG. 3A is a circuit diagram showing a pixel circuit of an organic light emitting display according to a first embodiment of the present invention.

FIG. 3A is a circuit diagram showing a pixel circuit of an organic light emitting display according to a first embodiment of the present invention.

Referring to FIG. 3A, the circuit diagram according to the first embodiment of the present invention has first transistor T1, a first capacitor C1, a second transistor T2, a third transistor T3, a fourth transistor T4, a second capacitor C2, a fifth transistor T5 and an organic light emitting diode OLED.

The first transistor T1 transmits a data signal from a data line Dm in response to a scan signal received from first scan line Sn1. The data signal transmitted from the first transistor T1 is stored in the first capacitor C1. Furthermore, the second transistor is for threshold voltage compensation. The threshold voltage of the second transistor T2 is transmitted by the diode-connection of the second transistor T2 because the fourth transistor T4 is turned on. The threshold voltage of the second transistor T2 is stored in the second capacitor C2. The fourth transistor T4 is turned on in response to control signal transmitted through control line AZ. When the fourth transistor T4 is turned on, the second transistor T2 is diode-connected. Furthermore, the third transistor T3 is turned on/off in response to a scan signal transmitted through second scan line Sn2. When the third transistor T3 is turned on, voltages of the first and the second capacitors C1 and C2 are combined. Hence, the combined voltage of node A is applied to gate electrode of the fifth transistor T5, so that the fifth transistor T5 generates driving current corresponding to the combined voltage. The generated driving current flows into the organic light diode OLED, so that the organic light emitting diode OLED emits light.

Electrodes of the first and the second capacitors C1 and C2 are connected to a first power line VDD. Furthermore, the other electrodes of the first and the second capacitors C1 and C2 are connected to source and drain electrodes of the third transistor T3. Also, the second and the fifth transistors T2 and T5 have same threshold voltage and same mobility.

Figure 3B:
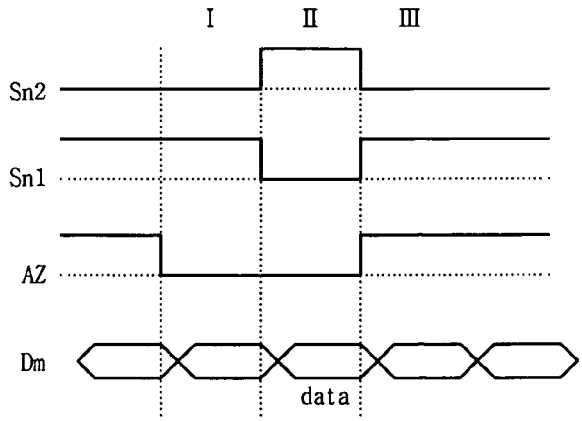
FIG. 3B is a timing diagram showing an operation of the pixel circuit of FIG. 3A according to the first embodiment of the present invention.

FIG. 3B is a timing diagram showing an operation of the pixel circuit of FIG. 3A according to the first embodiment of the present invention.

Referring to FIG. 3B, the operation of the pixel circuit has a programming step I, a data storing step II and a light-emitting step III.

In the programming step I, a high level signal is applied to the gate of the first transistor T1 through the first scan line Sn1, and a low level signal is applied to the second scan line Sn2 and the control line AZ. Due to the low level signal, the third transistor T3 and the fourth transistor T4 are turned on. Furthermore, the second transistor T2 is diode-connected by the turned on fourth transistor T4. Namely, because of the turned on the fourth transistor T4, the gate electrode and drain electrode of the second transistor T2 are electrically connected to each other. Furthermore, the threshold voltage of the transistor T2 is stored in the first capacitor C1 and the second transistor C2. Voltage $V_A$ of node A is shown by the following equation 2.

$$V_A = Vdd + Vth \qquad \text{Equation 2}$$

In the data storing step II, a high level signal is applied to the gate of the third transistor T3 through the second scan line Sn2, and a low level signal is applied to the first transistor T1 through the first scan line Sn1. Furthermore, the gate of the fourth transistor T4 receives a low level signal through the control line AZ. The first transistor T1 and the fourth transistor T4 are turned on by the low level signals and the data signal is applied through the data line Dm connected to the first transistor T1. The data signal may be a current signal and may be sunk through the data line Dm. When the data signal is applied, the first capacitor C1 stores a compensating voltage reflecting the threshold voltage and the mobility of the second transistor T2.

Current $I_{data}$ due to the data signal and the voltage $V_A$ of the node A are shown by equation 3.

Equation 3

$$V_A = V_c \tag{1}$$

$$I_{data} = \frac{1}{2}K_2(Vc - Vdd - Vth)^2 \tag{2}$$

$$Vc = Vdd + Vth - \sqrt{\frac{2I_{data}}{K_2}} \tag{3}$$

In the light-emitting step III, high level signals are applied through the first scan line Sn1 and the control line AZ, and a low level signal is applied through the second scan line Sn2. The third transistor T3 is turned on by the low level signal. Furthermore, the first transistor T1 and the fourth transistor T4 are turned off by the high level signal. Due to the turned on the third transistor T3, voltages stored in the first capacitor C1 and the second capacitor C2 are combined and the voltage $V_A$ of the node A is applied to gate electrodes of the second transistor T2 and the fifth transistor T5.

The voltage stored in the first capacitor C1 is voltage stored in the data storing step II by the current programming operation. Furthermore, the voltage stored in the second capacitor C2 in the programming step 1 is the threshold voltage of the second transistor T2. Hence, the combined voltage of the first capacitor C1 and the second capacitor C2 may reflect the threshold voltage and mobility of the second transistor T2. The voltage $V_A$ of the node A in the light-emitting step III is shown by the following equation 4.

Equation 4

$$V_A = \frac{C_1Vc + C_2(Vdd + Vth)}{C_1 + C_2}$$

Furthermore, the second transistor T2 is operated in triode a region, and the fifth transistor T5 is operated in a saturation region. Drain current Ids_T2 of the second transistor T2 is the same as drain current Ids_T5 of the fifth transistor T5. Furthermore, the drain current Ids_T5 flows into the organic light emitting diode OLED. The drain current Ids_T5 is shown by the following equation 5.

Equation 5

$$I_{ds-T_2} = K_2\left[(V_A - Vdd - Vth)(V_B - Vdd) - \frac{1}{2}(V_B - Vdd)^2\right] \tag{1}$$

-continued $$I_{ds-T_2} = \frac{1}{2}K_5(V_A - V_B - Vth)^2 \tag{2}$$

$$\left(K_2 = \mu C_{ox}\frac{W_{T_2}}{L_{T_2}},\ K_5 = \mu C_{ox}\frac{W_{T_5}}{L_{T_5}}\right) \tag{3}$$

$$I_{OLED} = I_{ds-T_2} = I_{ds-T_5} \tag{4}$$

$$I_{OLED} = \frac{1}{2}K_5\frac{K_2}{(K_2 + K_5)}(V_A - Vdd - Vth)^2 \tag{5}$$

In the equation 5, μ is mobility, Cox is capacitance of oxide, W is channel width, and L is channel length. Furthermore, current $I_{OLED}$ is current flowing into the organic light emitting diode OLED. $V_A$ is the combined voltage of the capacitors C1 and C2.

Furthermore, the current $I_{OLED}$ flowing into the organic light emitting diode OLED is shown by the following equation 6.

Equation 6

$$I_{OLED} = \left(\frac{K_5}{K_2 + K_5}\right)\left(\frac{C_1}{C_1 + C_2}\right)I_{data}$$

As shown in the equation 6, programmed current at the data storing step II may flow into the organic light emitting diode OLED having a predetermined ratio to the programmed current. Hence, the pixel circuit may drive the organic light emitting diode OLED by using the driving current $I_{OLED}$ with a predetermined ratio to programmed current data of the data signal.

When a low gray scale level is displayed according to the conventional art, the low gray scale level does not have adequate brightness due to parasitic capacitance and a low data signal. However, the pixel circuit according to the first embodiment of the present invention may receive and sink adequate data current and may display low gray scale level.

The current $I_{OLED}$ flowing into the organic light emitting diode OLED may be determined by a W/L of the second and the fifth transistors T2 and T5. Hence, ratio of output current to input current may be reduced by increasing the W/L of the second transistor T2. Furthermore, the current $I_{OLED}$ flowing into the organic light emitting diode OLED may be determined by a ratio of the capacitances of the capacitors C1 and C2. Hence, characteristics of the fifth transistor T5 generating the driving current may be optimized by controlling the capacitances of the capacitors C1 and C2 when the pixel circuit is designed.

Figure 4A:
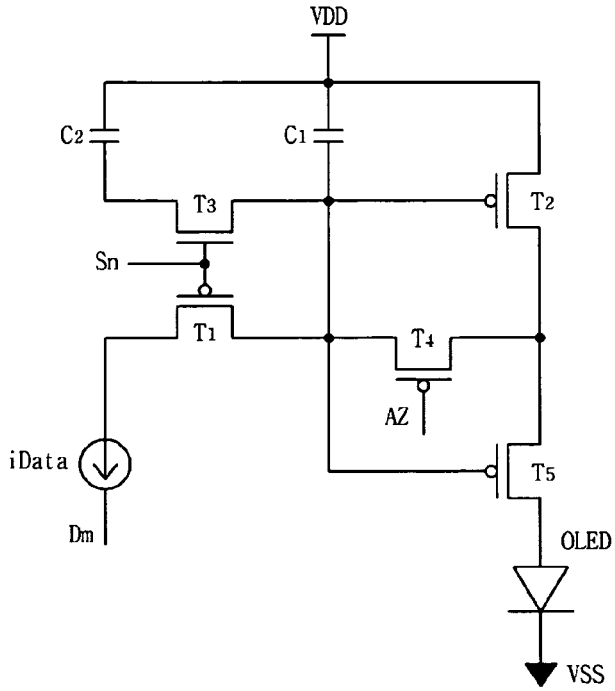
FIG. 4A is a circuit diagram of a pixel circuit according to a second embodiment of the present invention.
Figure 4B:
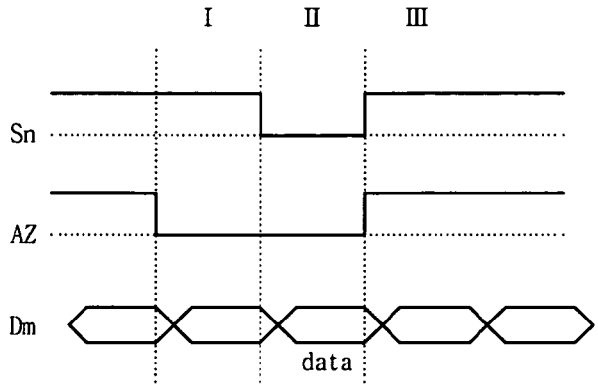
FIG. 4B is a timing diagram of a pixel circuit according to the second embodiment of the present invention.

FIG. 4A and FIG. 4B are a circuit diagram and a timing diagram of a pixel circuit according to second embodiment of the present invention.

Referring to FIG. 4A and FIG. 4B, the pixel circuit of the second embodiment has the same configuration as the pixel circuit of the first embodiment except that gate electrodes of the first and third transistor T1 and T3 are commonly connected to scan line Sn.

When first transistor T1 is turned on, third transistor T3 should be turned off such that the first and the third transistors T1 and T3 have opposite conduction types. Namely, the first transistor T1 may be PMOS, and the third transistor T3 may be NMOS. Hence, when a low level signal is applied through a scan line Sn, the first transistor T1 is turned on. When a high level signal is applied through the scan line Sn, the third transistor T3 is turned on.

When the first transistor T1 and the third transistor T3 are opposite conduction types, the number of signal lines may be decreased, so that manufacturing process may be simplified and the aperture ratio may be increased.

Figure 5A:
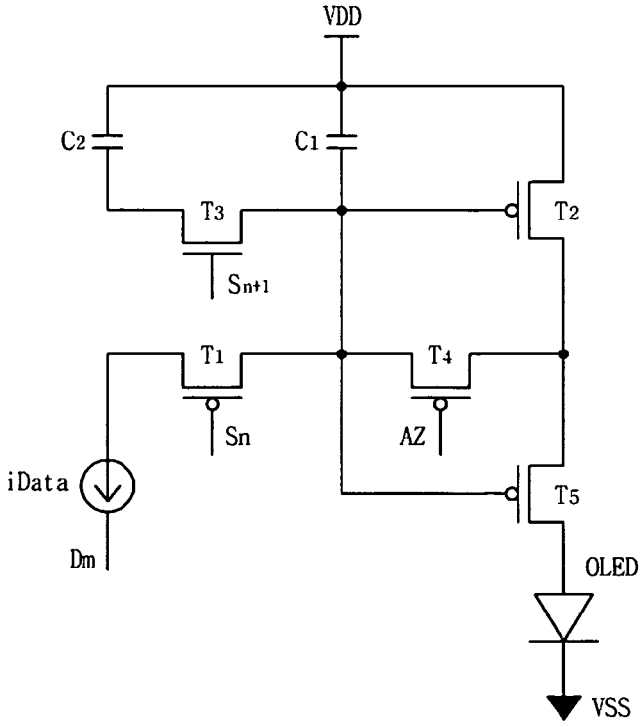
FIG. 5A is a circuit diagram of a pixel circuit according to a third embodiment of the present invention.
Figure 5B:
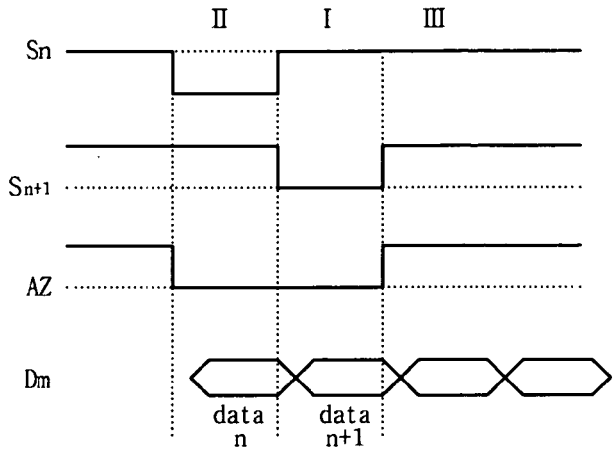
FIG. 5B is a timing diagram of a pixel circuit according to the third embodiment of the present invention.

FIG. 5A and FIG. 5B are a circuit diagram and a timing diagram of a pixel circuit according to a third embodiment of the present invention.

Referring to FIG. 5A and FIG. 5B, the pixel circuit of the third embodiment has the same configuration as the pixel circuit of the first embodiment except that gate electrode of first transistor T1 is connected to nth scan line Sn and gate electrode of third transistor T3 is connected to n+1th scan line Sn+1. Furthermore, the first transistor T1 may be PMOS and the third transistor T3 may be NMOS.

When a low level signal is applied through the nth scan line Sn, a high level signal is applied through the n+1th scan line Sn+1. Hence, when pixel circuits connected to the nth scan line store the data signal, pixel circuits connected to the n+1th scan line Sn+1 store the threshold voltage. When the pixel circuits connected to the nth scan line Sn emit light, the pixel circuits connected to the n+1th scan line Sn+1 may program the data current. The pixel circuit of the third embodiment may decrease the number of signal lines, so that manufacturing process may be simplified, and the aperture ratio may be increased.

Figure 6A:
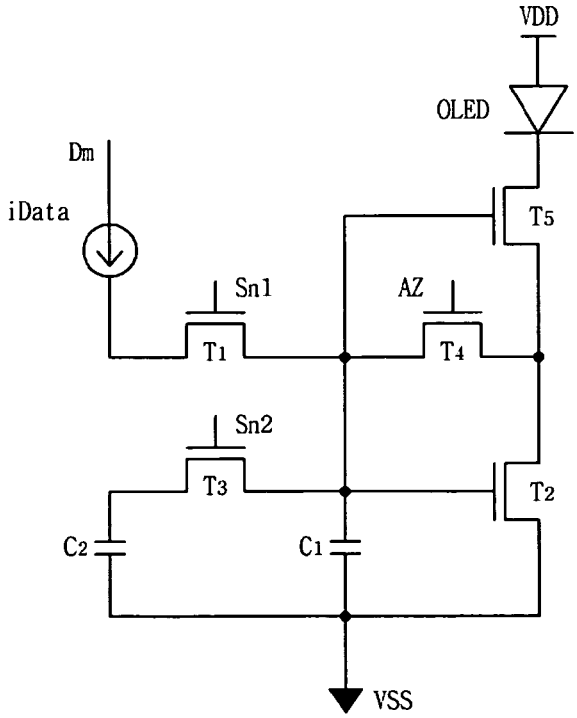
FIG. 6A is a circuit diagram of a pixel circuit according to a fourth embodiment of the present invention.
Figure 6B:
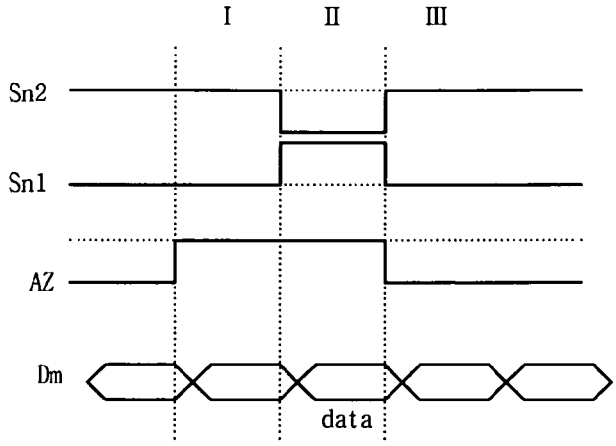
FIG. 6B is a timing diagram of a pixel circuit according to the fourth embodiment of the present invention.

FIG. 6A and FIG. 6B are a circuit diagram and a timing diagram of a pixel circuit according to a fourth embodiment of the present invention. Furthermore, FIG. 6A is a complementary circuit of FIG. 3A. Hence, the operation of the pixel circuit shown in FIG. 6B is complementary to FIG. 3B.

Figure 7A:
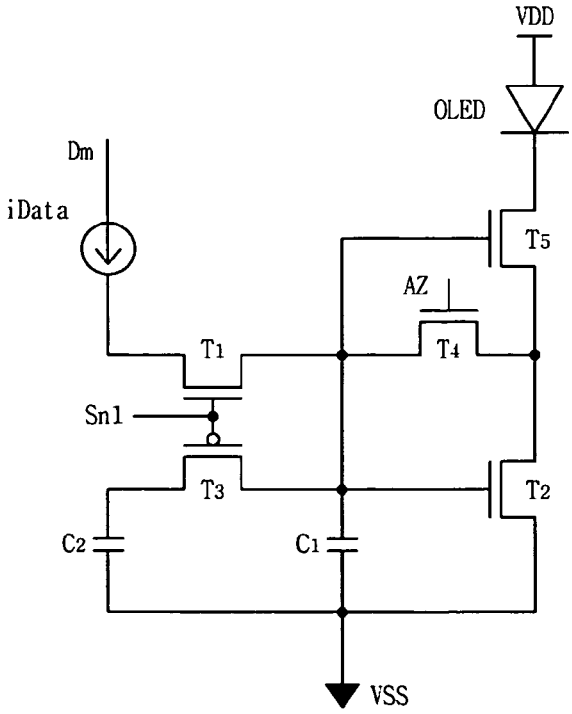
FIG. 7A is a circuit diagram of a pixel circuit according to a fifth embodiment of the present invention.
Figure 7B:
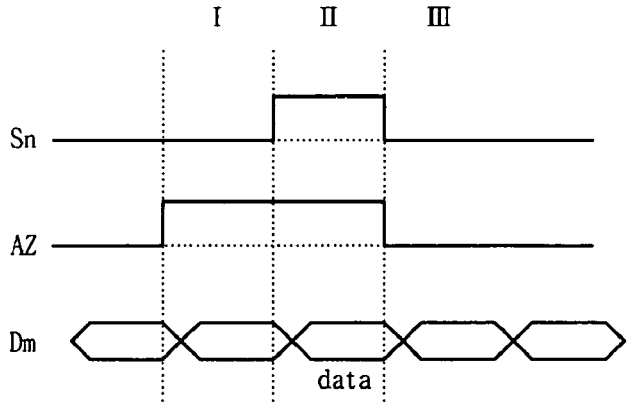
FIG. 7B is a timing diagram of pixel circuit according to the fifth embodiment of the present invention.

FIG. 7A and FIG. 7B are a circuit diagram and a timing diagram of a pixel circuit according to a fifth embodiment of the present invention. The pixel circuit shown in FIG. 7A is complementary to the pixel circuit shown in FIG. 4A. Hence, the operation of the pixel circuit showing FIG. 7B is complimentary to FIG. 4B.

Figure 8A:
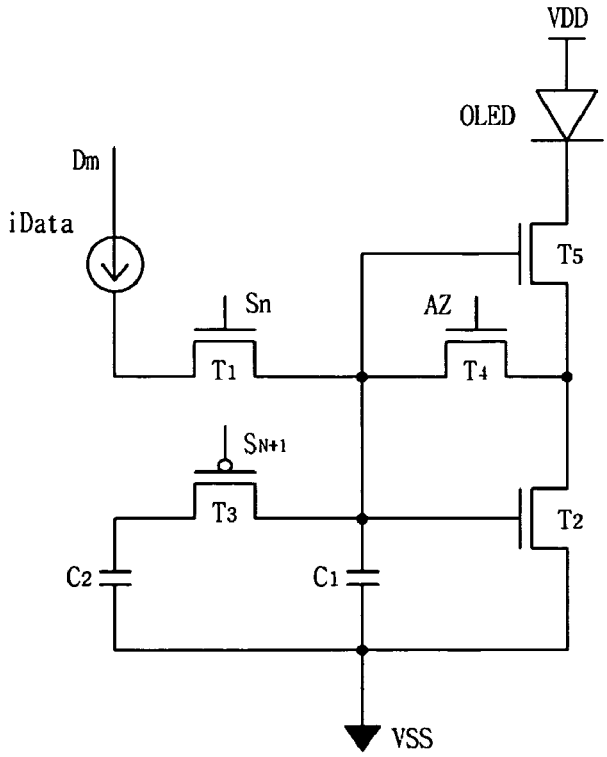
FIG. 8A is a circuit diagram of a pixel circuit according to a sixth embodiment of the present invention.
Figure 8B:
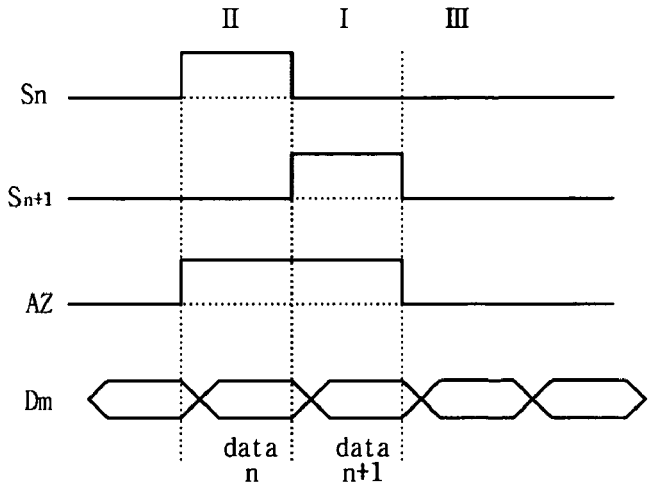
FIG. 8B is a timing diagram of a pixel circuit according to the sixth embodiment of the present invention.

FIG. 8A and FIG. 8B are a circuit diagram and a timing diagram of pixel circuit according to a sixth embodiment of the present invention. The pixel circuit shown in FIG. 8A is complementary to the pixel circuit shown in FIG. 8B. Hence, the operation shown in FIG. 8B is complementary to the operation shown in FIG. 6B.

Figure 9:
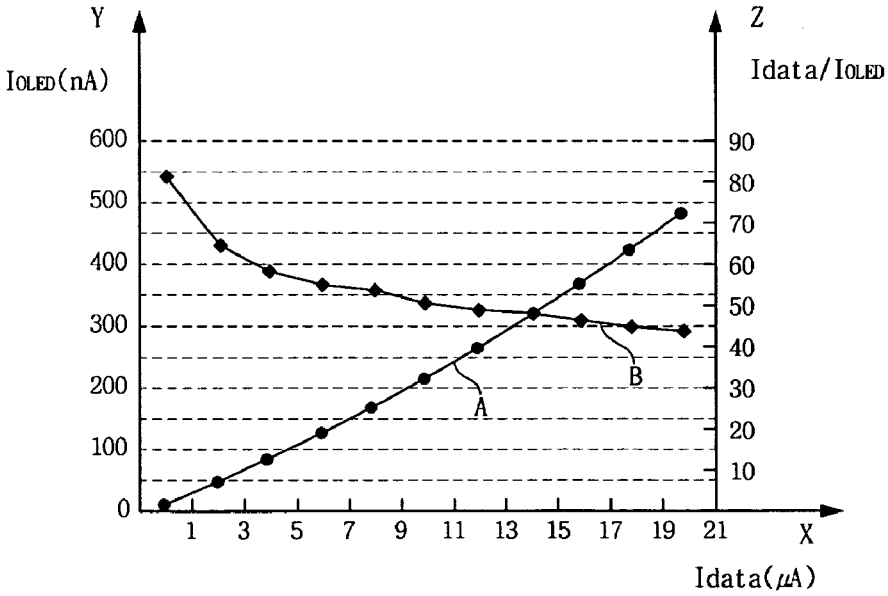
FIG. 9 is a simulation graph of current flowing organic light emitting diode of a pixel circuit according to the first embodiment of the present invention.

FIG. 9 is a graph of simulated current flowing into the organic light emitting diode of the pixel circuit according to the first embodiment of the present invention. In FIG. 9, the pixel circuit of the organic light emitting display according to the first embodiment is designed such that which the first and the second capacitors C1 and C2 have capacitances of 150 pF. Furthermore, the ratio K2:K5 of the second and the fifth transistor T2 and T5 is designed to be 4:1.

Graph A shows the current $I_{OLED}$ flowing into the organic light emitting diode OLED according to current $I_{data}$ due to a data signal applied in the programming step. Graph B shows the ratio of current $I_{data}$ with respect to the current $I_{OLED}$.

Referring to FIG. 9, when the current $I_{data}$ programmed by the data signal is about 21 μA, the current $I_{OLED}$ flowing into the organic light emitting diode OLED is about 480 nA. Hence, the pixel circuit according to the first embodiment may control the current $I_{OLED}$ to have ratio of 1:40 with respect to the current $I_{data}$.

The pixel circuits of the present invention may effectively compensate for the variation of the threshold voltage and the mobility of a driving transistor such that the uniformity of brightness of pixels may be improved. Because the ratio of the current $I_{data}$ due to the data signal and the current $I_{OLED}$ flowing the organic light emitting diode OLED may be controlled, a low gray scale level may be easily displayed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A pixel circuit of an organic light emitting display comprising:

a first transistor that transmits a data signal from a data line in response to a scan signal from a scan line;

a first capacitor that stores the data signal received from the first transistor;

a second transistor for threshold voltage compensation;

a third transistor that transmits the threshold voltage of the second transistor;

a fourth transistor that connects the gate and drain of the second transistor in a diode-connected configuration in response to a control signal from a control line;

a second capacitor that stores the threshold voltage received through the third transistor;

a fifth transistor that generates a driving current corresponding to a combined voltage of the first and the second capacitors due to the turned on third transistor; and an organic light emitting diode that emits light according to the driving current.

2. The pixel circuit of claim 1, wherein the second transistor and the fifth transistor have the same threshold voltage and mobility.

3. The pixel circuit of claim 1, wherein the first capacitor and the second capacitor are commonly connected to a first power line.

4. The pixel circuit of claim 1, wherein the second transistor has larger width to length ratio than that of the fifth transistor.

5. The pixel circuit of claim 1, wherein the first transistor is connected to a first scan line and the third transistor is connected to a second scan line.

6. The pixel circuit of claim 5, wherein the second transistor is diode-connected when a low level signal is applied through the control line, so that the diode-connected second transistor transmits the threshold voltage to the second capacitor through the third transistor.

7. The pixel circuit of claim 6, wherein the first capacitor stores the data signal when the first transistor and the fourth transistor are turned on.

8. The pixel circuit of claim 7, wherein the combined voltage of the first and the second capacitor is applied to gate electrodes of the second and fifth transistors when the third transistor is turned on and the first and the fourth transistors are turned off.

9. The pixel circuit of claim 8, wherein the fifth transistor generates the driving current that is the same with current flowing through the second transistor when the combined voltage of the first and the second capacitors is applied to the gate electrode of the fifth transistor, so that the driving current flows into the organic light emitting diode.

10. The pixel circuit of claim 1, wherein the first through the fifth transistors are PMOS transistors.

11. The pixel circuit of claim 1, wherein the first, the second, the fourth and the fifth transistors are the PMOS transistors and the third transistor is NMOS transistor.

12. The pixel circuit of claim 11, wherein the first and the third transistors have gate electrodes commonly connected to scan line.

13. The pixel circuit of claim 11, wherein the first transistor is connected to nth scan line and the third scan line is connected to n+1th scan line.

14. The pixel circuit of claim 1, wherein the first through the fifth transistors are NMOS transistors.

15. The pixel circuit of claim 14, wherein the first power line supplies negative source voltage.

16. The pixel circuit of claim 15, wherein the fifth transistor has a drain electrode connected to cathode electrode of the organic light emitting diode.

17. The pixel circuit of claim 1, wherein the first, the second, the fourth and the fifth transistors are NMOS transistors, and the third transistor is a PMOS transistor.

18. The pixel circuit of claim 17, wherein the first and the third transistors have gate electrodes commonly connected to scan line.

19. The pixel circuit of claim 17, wherein the first transistor is connected to nth scan line and the third transistor is connected to n+1th scan line.

* * * * *